US007047789B1

(12) United States Patent
Theener

(10) Patent No.: US 7,047,789 B1
(45) Date of Patent: May 23, 2006

(54) PIPE BENDING APPARATUS

(76) Inventor: Ronald E. Theener, HCR #64, Box 290, Duchesne, UT (US) 84021

( * ) Notice: Subject to any disclaimer, the term of this patent is extended or adjusted under 35 U.S.C. 154(b) by 38 days.

(21) Appl. No.: 11/180,750

(22) Filed: Jul. 13, 2005

(51) Int. Cl.
*B21D 3/10* (2006.01)
*B21D 9/08* (2006.01)

(52) U.S. Cl. ..... 72/382; 72/389.1; 72/389.8; 72/389.6; 72/390

(58) Field of Classification Search ..... 72/381, 72/383, 389.6, 389.1, 389.8, 466, 466.8, 72/390
See application file for complete search history.

(56) References Cited

U.S. PATENT DOCUMENTS

| | | | | |
|---|---|---|---|---|
| 2,938,564 A | | 5/1960 | Rhodes | |
| 3,722,038 A | | 3/1973 | Arntz | |
| 3,934,450 A | | 1/1976 | Reed | |
| 4,313,330 A | | 2/1982 | Cummings | |
| 4,331,018 A | | 5/1982 | Doyle | |
| 5,123,272 A | * | 6/1992 | Heaman | 72/389.8 |
| 5,237,847 A | | 8/1993 | Owens | |
| 5,353,622 A | | 10/1994 | Theener | |
| 5,431,035 A | | 7/1995 | Sheen | |
| 5,469,730 A | * | 11/1995 | Heaman | 72/389.6 |
| 5,499,521 A | | 3/1996 | Luikart | |
| 5,600,993 A | * | 2/1997 | Heaman | 72/389.6 |
| 5,884,519 A | | 3/1999 | Theener | |
| 6,389,872 B1 | | 5/2002 | Hanson | |

* cited by examiner

*Primary Examiner*—David B. Jones
(74) *Attorney, Agent, or Firm*—Sturm & Fix LLP

(57) ABSTRACT

An improved pipe bending apparatus comprising a plurality of belts supporting the minor radius of the bend. The belts cannot support stresses sufficient to allow concentrated stress to cause the pipe walls to collapse. The belts are affixed to a framework that forces the belts into the sides of the pipe, thereby providing support to maintain ovality of the pipe cross-section.

11 Claims, 3 Drawing Sheets

PIPE BENDING APPARATUS

DESCRIPTION OF RELATED ART

This application is an improvement over U.S. Pat. No. 5,884,519 which issued on Oct. 11, 1994 and is entitled "Articulated Three Point Bending Apparatus", the content of which is incorporated herein by reference.

As can be seen by reference to the following U.S. Pat. Nos. 2,938,564; 3,934,450; 4,331,018; and 5,237,847, the prior art is replete with myriad and diverse pipe bending apparatuses.

While all of the aforementioned prior art constructions present improvements for pipe bending machinery, they are uniformly deficient with respect to their failure to provide a simple and practical pipe bending system for consistently maintaining ovality of a pipe during the bending process.

As most individuals who operate pipe bending machines are all too well aware, uneven application of the bending pressure on a length of pipe most often results in the collapse or crushing of the pipe walls in the vicinity of the bend, thereby rendering that particular pipe section useless. Not only is this a waste of materials, the operators' time is also wasted, both causing the pipe bending process to be unnecessarily expensive.

As a consequence of the foregoing situation, there has existed a longstanding need for a new and improved type of pipe bending machine providing adequate support to the pipe walls during bending to avoid collapse and maintain ovality of the pipe.

BRIEF SUMMARY OF THE INVENTION

An object of the present invention is a pipe bending apparatus consistently providing successful bends wherein ovality of the pipe cross-section is maintained. A related object of the invention is a pipe bending apparatus avoiding the collapsing of the pipe walls during the bending operation.

To effect the above objects, a plurality of belts is used to support the pipe walls during bending. Each belt contacts approximately half of the circumference of the pipe, in the minor radius region of the bend. The belts are secured to frameworks on each side of the pipe. The frameworks pivot to allow the belt ends to draw nearer the pipe as the pipe is forced into its bend, thereby providing forces to counter the tendency of the pipe to flatten. Springs provide a force to draw the ends of the belts apart to permit the insertion of the pipe.

In a preferred embodiment, the pipe is inserted beneath the belts, such that the belts lie on the top half of the circumference of the pipe. Hydraulic cylinders provide the force required to bend the pipe upward toward at least at one end from the bend. As the pipe moves upward under force of the bending machine, the pipe comes into contact with the belts. The force on the belts from the pipe causes the ends of the belts to draw in toward the sides of the pipe, thereby providing support to maintain ovality and resist collapsing the pipe walls. The spring that provides a force to hold the ends of the belts apart is drawn into tension and the frameworks on both sides of the pipe pivot to allow the ends of the belts to come into contact with the sides of the pipe.

DETAILED DESCRIPTION OF THE INVENTION

Figure 1:
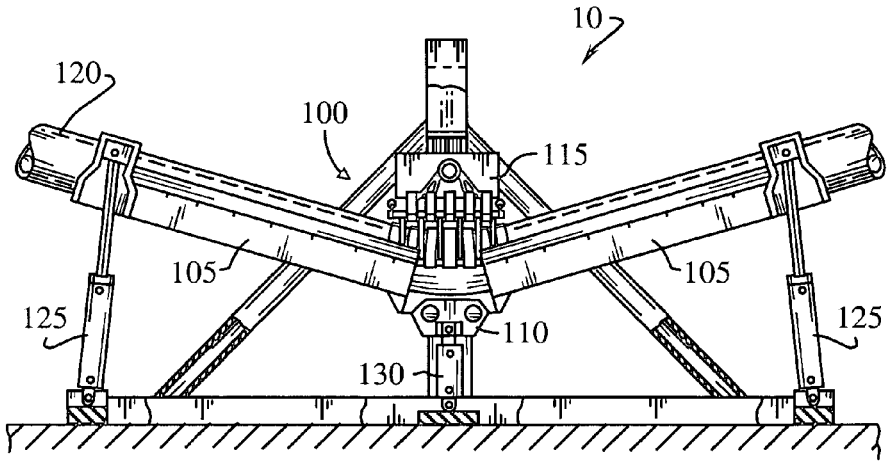
FIG. 1 is a first front elevation view of a pipe bending apparatus.
Figure 2:
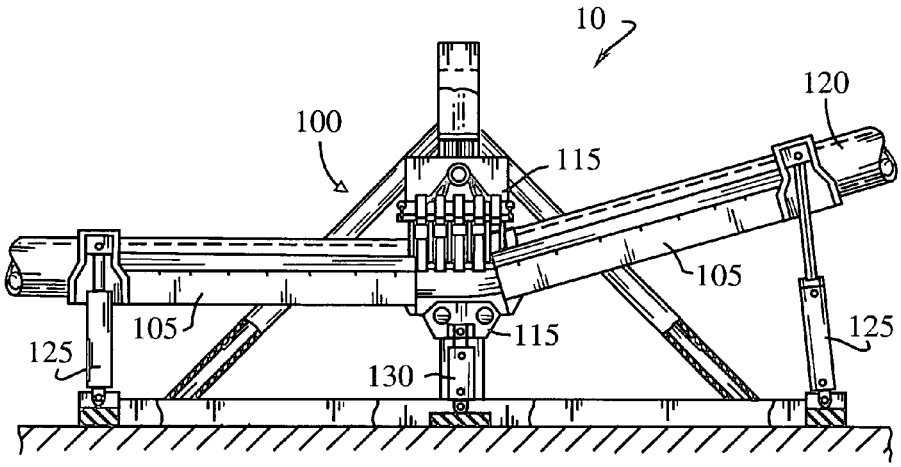
FIG. 2 is a second front elevation view of the pipe bending apparatus.
Figure 3:
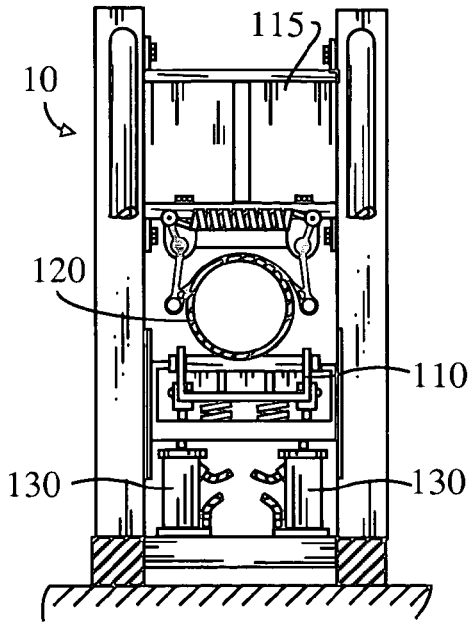
FIG. 3 is a side elevation view of the pipe bending apparatus.

As shown in FIGS. 1–3, the pipe bending apparatus is designated generally as 10 and includes a pair of elongated bed members 105 whose inboard ends are pivotally connected to a floating hinge plate 110 which cooperates with a pin up plate 115 which holds the top pipe die for captively engaging a section of pipe 120 such that the relative movement between the hinge plate 110, the pin up plate 115, and the bed members 105 will produce a selected bend or curvature in the section of pipe 120 at the juncture of the hinge plate 110 and the pin up plate 115.

Referring mainly to FIGS. 1–2, it can be seen that the outboard end of the bed members 105 are operatively associated with the bending bed hydraulic ram units 125, the hinge plate 110 is operatively associated with the hinge plate hydraulic ram unit 130.

Figure 4:
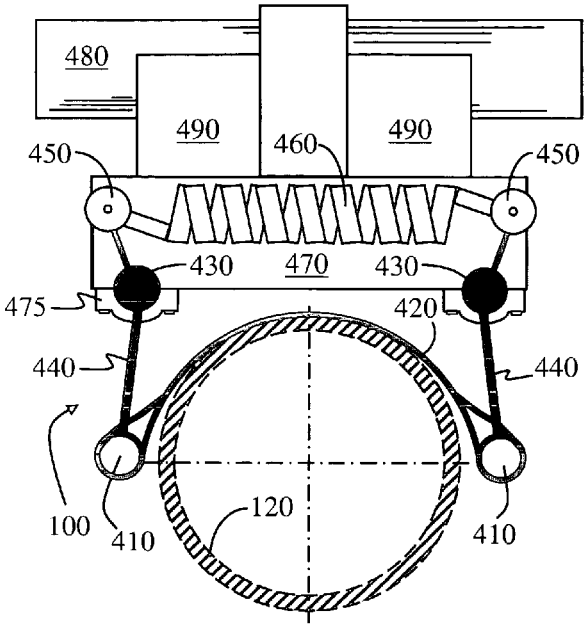
FIG. 4 is a side elevation view of a harness assembly used in the pipe bending apparatus.
Figure 5:
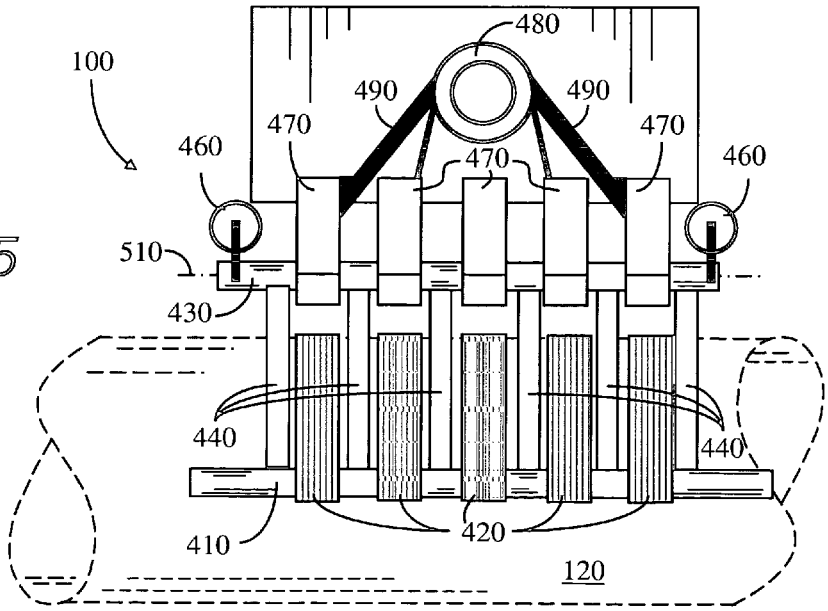
FIG. 5 is a front elevation detail view of the harness assembly.

A harness assembly 100 is also seen in FIGS. 1–3, but is shown in detail in FIGS. 4 and 5. The harness assembly includes a framework comprising a pair of lower members 410 in proximity to the horizontal diameter of the pipe 120 circumference. A plurality of belts 420 are affixed to the lower members 410 as best seen in FIG. 4. The belts 420 cannot support stresses as can a rigid material such as steel. Therefore, the stress concentration that results in collapse of the pipe 120 is much less likely to occur with the use of the belts 420. The lower members 410 are rigidly affixed to a pair of upper members 430 by a plurality of ribs 440, preferably one rib 440 between each two belts 420 as best seen in FIG. 5. Lever arms 450 are rigidly affixed to the upper members 430 for attachment to a spring 460. The spring 460, in conjunction with the lever arms 450, tends to pivot the upper members 430 about their longitudinal axes 510 to draw the lower members 410 and the belt 420 ends apart. This eases the insertion of the pipe 120. When the pipe 120 is bent, the pipe 120 is forced upward into the belts 420, causing the spring 460 to expand and permit the lower members 410 to draw inward, toward the pipe 120, thus providing a force to keep the pipe 120 from collapsing, thereby maintaining ovality.

The upper members 430 pivot in bearings that are held in place by a series of blocks 470 with bearing caps 475.

The harness assembly 100 is attached to the pin up plate 115 of the pipe bending machine 10 via a round tubing member 480. The blocks 470 are braced against the round tubing member 480 by braces 490.

Figure 6:
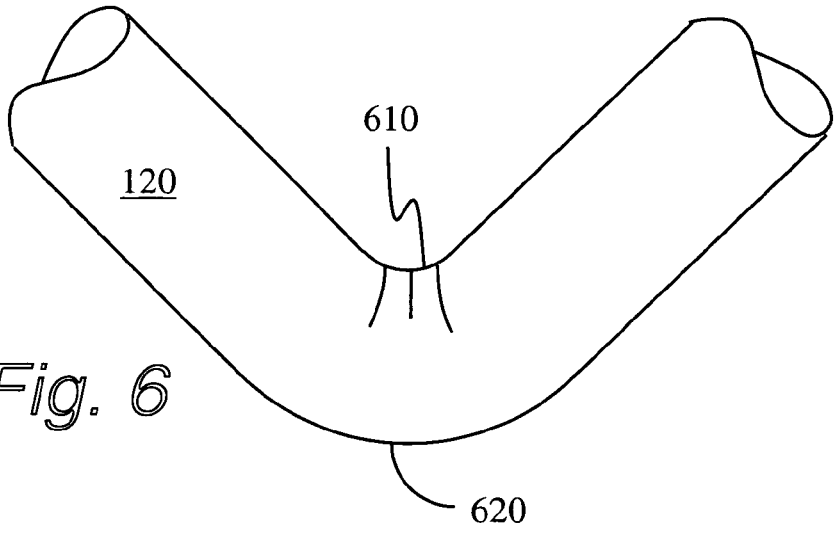
FIG. 6 is a view of a bent pipe.

Viewing the pipe 120 in FIG. 6, in practice, the belts 420 in the harness assembly 100 support what will become the region of the minor radius 610 of the pipe 120. Opposite the minor radius 610 is the major radius 620.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A method of providing support for a pipe having a circumference during bending of said pipe in a pipe bending machine comprising a harness assembly including a belt having two ends, said method comprising:

(a) extending the belt over approximately one half of the pipe's circumference;

(b) affixing the two ends of the belt in a proximity of a diameter of the pipe;

(c) supporting a pipe wall in a region of a minor radius of the bend with the belt;

(d) including a plurality of belts, all the plurality of belts supporting the pipe wall in a region of a minor radius of the bend;

the pipe bending machine also comprises a first framework and a second framework, the two ends of the belt comprising a first end and a second end, the method additionally comprising:

(a) operatively affixing the first end of the belt to the first framework;

(b) operatively affixing the second end of the belt to the second framework; and (c) operatively pivotally attaching the first and second frameworks to the pipe bending machine such that the first and second ends of the belt may move toward and away from the pipe.

2. The method of claim 1 wherein the first frameworks comprises an upper member, a lower member, and a rib, wherein operatively pivotally attaching the first framework to the pipe bending machine comprises:

(a) operatively rigidly connecting the upper member to a first end of the rib;

(b) operatively rigidly connecting the lower member to a second end of the rib; and (c) operatively pivotally attaching the upper member of the first framework to the pipe bending machine.

3. The method of claim 2 wherein the second frameworks comprises an upper member, a lower member, and a rib, wherein operatively pivotally attaching the second framework to the pipe bending machine comprises:

(a) operatively rigidly connecting the upper member to a first end of the rib;

(b) operatively rigidly connecting the lower member to a second end of the rib; and (c) operatively pivotally attaching the upper member of the second framework to the pipe bending machine.

4. The method of claim 3 additionally comprising forcing the lower member of the first framework and the lower member of the second framework apart relative to one another with a spring.

5. The method of claim 1 including forcing the pipe into the belt during bending.

6. An apparatus for a pipe bending machine comprising:

(a) a pin up plate;

(b) a first framework operatively pivotally attached to the pin up plate;

(c) a second framework operatively pivotally attached to the pin up plate;

(d) at least one belt having two ends, a first end operatively attached to the first framework and the second end operatively attached to the second framework, said belt disposed to an outer surface of a pipe wall in a region that becomes a minor radius of a bend in the pipe; and (e) an actuator by which the pipe is forced into the belt.

7. The apparatus of claim 6 wherein the first and second frameworks each comprise:

(a) an upper member;

(b) a lower member spaced apart from and substantially parallel to the upper member to which the at least one belt is operatively attached; and (c) at least one rib operatively rigidly affixed to the upper and lower members to space the upper member from the lower member.

8. The apparatus of claim 6 additionally comprising a spring to cause the first and second frameworks to separate the first and second ends of the at least one belt.

9. The apparatus of claim 7 additionally comprising:

(a) a plurality of blocks each block shaped to receive a bearing, the blocks rigidly spaced apart to allow the at least one rib to pass between;

(b) a plurality of bearing caps disposed to the plurality of blocks;

(c) a plurality of bearings seated in the plurality of blocks and the plurality of bearing caps and into which the upper members are pivotally disposed; and (d) a connecting member to operatively connect the plurality of blocks to the pin up plate.

10. The apparatus of claim 9 wherein the connecting member comprises a round tubing member.

11. The apparatus of claim 9 wherein each of the plurality of bearings comprises:

(a) a first bearing half disposed in one of the plurality of blocks; and (b) a second bearing half disposed in one of the plurality of bearing caps.

* * * * *